US007509777B2

(12) United States Patent
Nakaki et al.

(10) Patent No.: US 7,509,777 B2
(45) Date of Patent: Mar. 31, 2009

(54) BASE CONNECTION FOR CONNECTING A CONCRETE WALL PANEL TO A FOUNDATION

(75) Inventors: Suzanne Nakaki, Santa Ana, CA (US); Roger Becker, Greenfield, WI (US)

(73) Assignee: Spancrete Machinery Corporation, Waukesha, WI (US)

( * ) Notice: Subject to any disclaimer, the term of this patent is extended or adjusted under 35 U.S.C. 154(b) by 538 days.

(21) Appl. No.: 11/168,630

(22) Filed: Jun. 28, 2005

(65) Prior Publication Data

US 2006/0000167 A1 Jan. 5, 2006

Related U.S. Application Data

(60) Provisional application No. 60/583,333, filed on Jun. 28, 2004.

(51) Int. Cl.
*E02D 27/00* (2006.01)
*E04H 1/00* (2006.01)

(52) U.S. Cl. ..... 52/293.3; 52/241; 52/235; 52/293.2; 52/167.1

(58) Field of Classification Search ..... 52/241, 52/235, 293.2, 167, 481.2, 407.3, 731.5, 52/309.7, 309.8, 309.9, 745.09, 742.12, 742.1
See application file for complete search history.

(56) References Cited

U.S. PATENT DOCUMENTS

| | | | | |
|---|---|---|---|---|
| 2,387,389 | A | 10/1945 | Goldsmith | |
| 4,052,925 | A | 10/1977 | McCarthy | |
| 4,194,333 | A * | 3/1980 | Paton et al. | 52/235 |
| 4,452,019 | A | 6/1984 | Ikuo et al. | |
| 4,697,398 | A | 10/1987 | Granieri | |
| 4,750,306 | A | 6/1988 | Granieri | |
| 4,782,635 | A * | 11/1988 | Hegle | 52/126.4 |
| 4,875,319 | A | 10/1989 | Hohmann | |
| 4,924,648 | A | 5/1990 | Gilb et al. | |
| 4,987,708 | A | 1/1991 | Wilcox | |
| 5,085,026 | A | 2/1992 | McGill et al. | |
| 5,375,384 | A | 12/1994 | Wolfson | |
| 5,392,581 | A | 2/1995 | Hatzinikolas et al. | |
| 5,548,939 | A * | 8/1996 | Carmical | 52/707 |
| 5,609,005 | A | 3/1997 | Schierloh et al. | |

(Continued)

FOREIGN PATENT DOCUMENTS

| | | |
|---|---|---|
| DE | 2120485 | 11/1972 |

*Primary Examiner*—Vickie Kim
*Assistant Examiner*—Alp Akbasli
(74) *Attorney, Agent, or Firm*—Boyle Fredrickson, S.C.

(57) ABSTRACT

A base connection is provided for supporting a concrete wall panel on an underlying support structure. The base connection comprises a generally vertical mounting plate, a wall plate, a pair of slips, and a cover plate secured to and extending upwardly from the support structure. The mounting plate includes one or more generally vertically-elongated slots. The wall plate is embedded within the concrete wall panel toward a lower end defined by the concrete wall panel. The cover plate is located outwardly of the mounting plate. An inner slip plate is located between the mounting plate and the wall plate, and an outer slip plate is located between the cover plate and the mounting plate. Threaded connectors extend interconnect the cover plate and the embedded wall plate, extending through openings in the slip plates and through one of the generally vertically aligned slots in the mounting plate.

10 Claims, 9 Drawing Sheets

U.S. PATENT DOCUMENTS 5,706,626 A 1/1998 Mueller
5,813,175 A * 9/1998 Hiragaki ..... 52/167.1
5,845,453 A * 12/1998 Goya ..... 52/702
6,003,276 A 12/1999 Hegemier et al.
6,115,972 A 9/2000 Tamez
6,237,292 B1 5/2001 Hegemier et al.
6,418,684 B1 * 7/2002 Morton ..... 52/293.2
6,502,362 B1 1/2003 Zambelli et al.
6,550,200 B1 4/2003 Mueller
6,560,940 B2 5/2003 Mueller
6,658,810 B2 12/2003 DeLoach, Sr.
6,698,150 B1 3/2004 DiLorenzo

* cited by examiner

BASE CONNECTION FOR CONNECTING A CONCRETE WALL PANEL TO A FOUNDATION

CROSS REFERENCE TO RELATED APPLICATIONS

This application claims priority from U.S. Provisional Application Ser. No. 60/583,333 filed on Jun. 28, 2004, and is hereby incorporated herein by reference in its entirety.

FIELD OF THE INVENTION

The present invention relates generally to a base connection for and method of supporting a wall panel on an underlying support structure. More specifically, the invention relates to a base connection configured to withstand seismic loading conditions, such as resisting wall uplift, due to rocking movement of the wall panel during a seismic event.

BACKGROUND OF THE INVENTION

Prestressed concrete wall panels provide a widely used, efficient building system. The prestressed wall panels are typically secured to an underlying support structure, such as a foundation wall. Known wall panels have been primarily developed to withstand loads associated with wind and gravity. However, there is a need for wall structures that better withstand effects associated with earthquakes. In particular, there is a need for a connection between wall panels and support structures that provides enhanced resistance to uplift forces associated with rocking of the wall panel during a seismic event.

SUMMARY OF THE INVENTION

In accordance with a first aspect of the present invention, there is provided a base connection for supporting a concrete wall panel on an underlying support structure. The base connection comprises a generally vertical mounting plate secured to and extending upwardly from the support structure. The mounting plate includes one or more generally vertically-elongated slots that are generally vertically aligned to each another. A wall plate is embedded within the concrete wall panel toward a lower end defined by the concrete wall panel. A cover plate is located outwardly of the mounting plate. Slip plates are located on each side of the mounting plate, an inner slip plate located between the mounting plate and the wall plate and an outer slip plate located between the cover plate and the mounting plate. One or more threaded connectors extend between and interconnect the cover plate and the embedded wall plate. Each threaded connector extends through openings in the slip plates and through one of the generally vertically aligned slots in the mounting plate. A spring washer is interposed between the cover plate and an outer end defined by each threaded connector.

In a preferred embodiment of the base connection, the one or more threaded connectors extend through one of the vertically-elongated slots in the mounting plate and the one or more openings in the cover plate, the wall plate, and the slip plates. A threaded receiver is embedded behind the wall plate and in alignment with each of the above described openings. Each spring washer is located between the cover plate and a head of the threaded connector, and a threaded shank of the threaded connector is engaged with the threaded receivers. The base connection further includes a foundation plate attached at a lower edge of the mounting plate. The foundation plate is aligned generally perpendicular to the mounting plate and embedded in the support structure, and extends generally underneath the wall panel. The base connection further includes a spacer plate attached at an inner surface of the wall plate facing the concrete wall panel, and at least one vertically aligned reinforcing bar embedded in the concrete wall panel. The at least one reinforcement bar extends above an upper end of the wall plate, and includes a lower end attached to the wall plate via the spacer plate. The base connection further includes at least one rectangular-shaped stud and at least one headed stud embedded to anchor the wall plate to the concrete wall panel. The at least one headed stud is located at an inner face of the wall plate facing the concrete panel wall, and includes a shank having a free end attached at the wall plate.

In accordance with a further aspect of the present invention, there is provided a method of supporting a concrete wall panel on an underlying support structure, comprising the steps of embedding a wall plate within a lower end defined by the wall panel; securing a generally vertical mounting plate to the support structure, wherein the mounting plate includes one or more generally vertically elongated slots; positioning a pair of slip plates one on either side of the mounting plate such that an inner slip plate is located between the mounting plate and the wall plate; positioning a cover plate outwardly of the mounting plate, wherein an outer slip plate is located between the cover plate and the mounting plate; positioning one or more spring washers outwardly of the cover plate; and connecting the cover plate, the slip plates and the embedded wall plate to the mounting plate via one or more threaded connectors that interconnect the cover plate and the embedded wall plate, wherein each threaded connector extends through one of the spring washers and through openings in the slip plates and one of the generally vertically elongated slots in the mounting plate.

The method can further include the steps of securing the wall plate to at least one vertically aligned reinforcement bar embedded in the concrete wall via a spacer plate attached at an inner surface of the wall plate facing the concrete wall panel; embedding a foundation plate in the underlying support structure; and attaching the foundation plate at a lower end of the vertical mounting plate such that at least a portion of the foundation plate extends underneath the wall panel. The method can still further include the additional steps of filling grout between the foundation plate and the wall panel; anchoring the wall plate in the concrete wall panel with at least one rectangular-shaped stud attached at the inner face of the wall plate facing the concrete panel; and securing the wall plate in the concrete wall panel with at least one horizontally aligned stud located at an inner face of the wall plate facing the concrete panel wall, where each of the at least one horizontally aligned stud includes a shank having a free end attached at the embedded wall plate.

Various other features, objects and advantages of the invention will be made apparent from the following description taken together with the drawings.

DETAILED DESCRIPTION OF THE PREFERRED EMBODIMENTS

Figure 1:
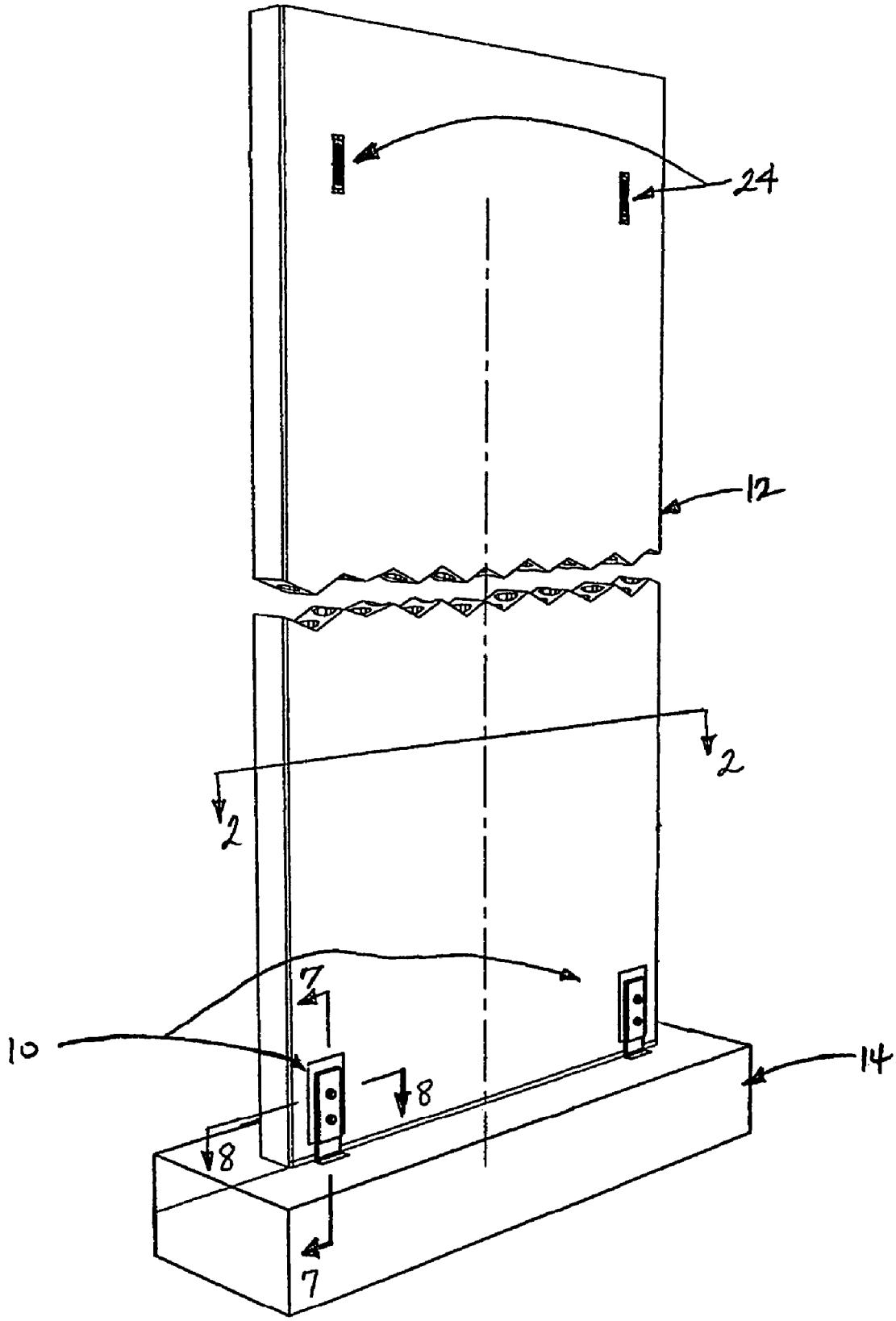
FIG. 1 shows a pictorial view of a base connection in accordance with the present invention connecting a concrete wall panel to a foundation.

Referring to FIG. 1, the present invention contemplates a base connection, shown generally at 10, for securing a concrete wall panel 12 to an underlying support structure, such as a foundation 14. Base connection 10 is designed for use in buildings constructed in seismically active regions, in which the connection of the wall panel 12 to a foundation 14 must be capable of withstanding seismic loading conditions. The purpose of connection 10 is to provide a tension tie for the wall panel 12 to the foundation 14 with the capacity to resist uplift associated with wall rocking during a seismic event.

Figure 7:
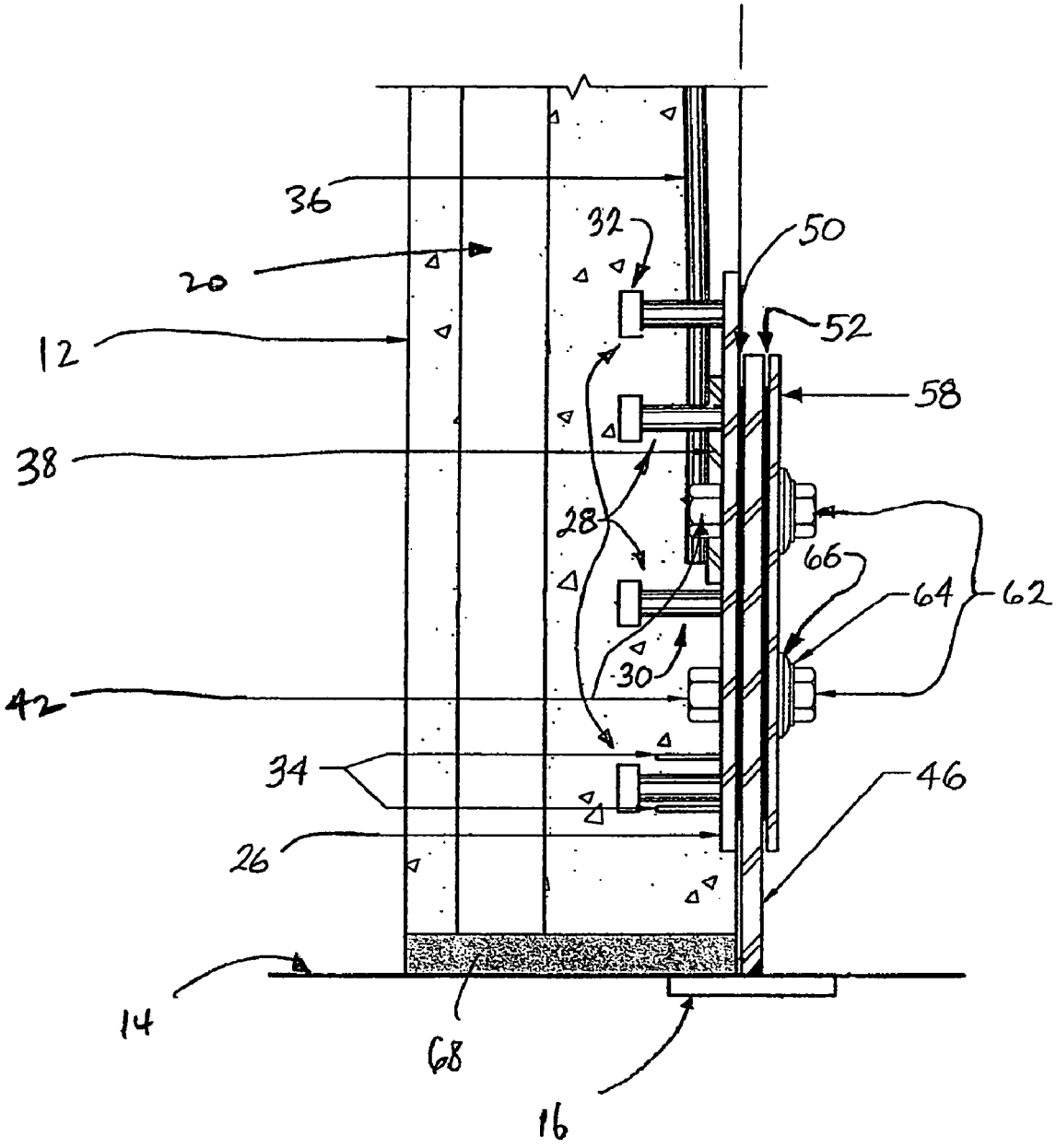
FIG. 7 is a cross-section view of the base connection along line 7-7 in FIG. 4.

As shown in FIG. 7, the base connection 10 includes a foundation plate 16 embedded in the foundation 14, with which wall panel 12 is interconnected in a manner to be explained in further detail below.

Figure 2:
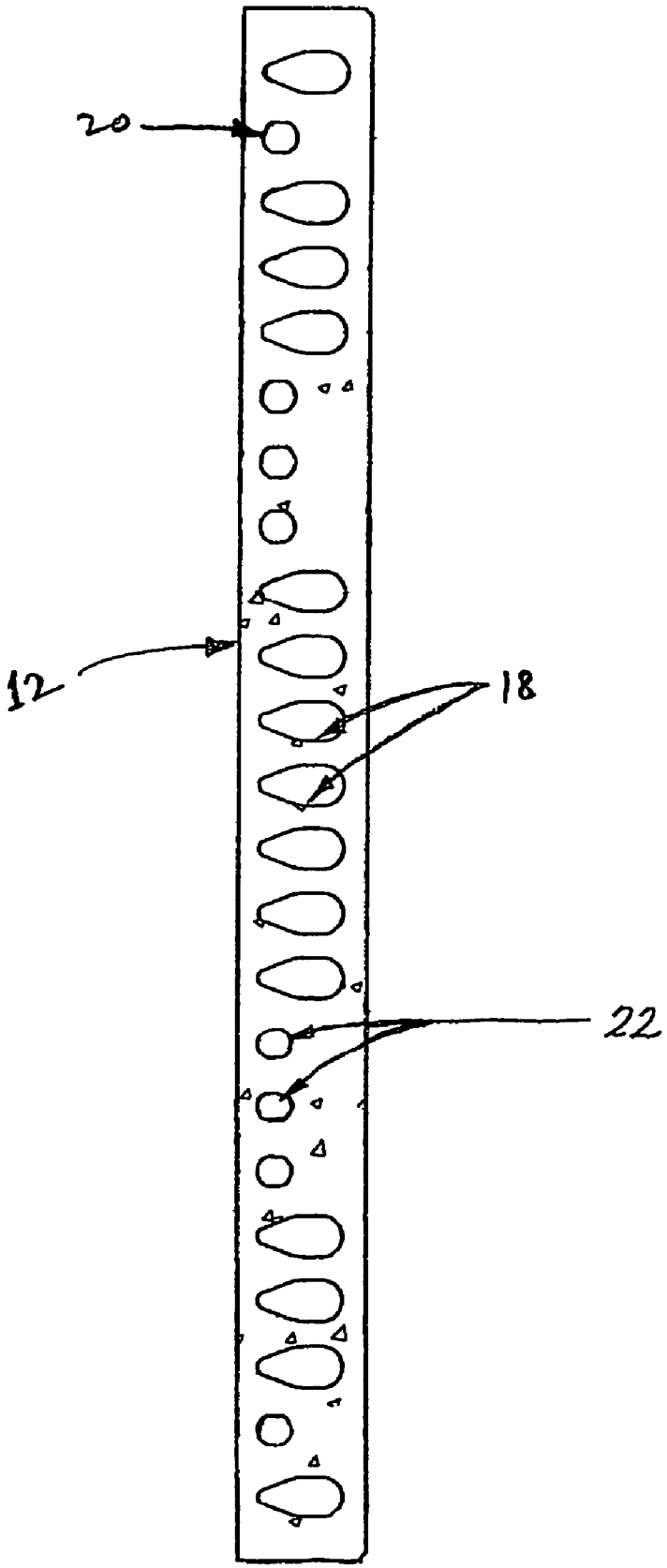
FIG. 2 is a cross-section view of the wall panel along line 2-2 in FIG. 1.
Figure 3:
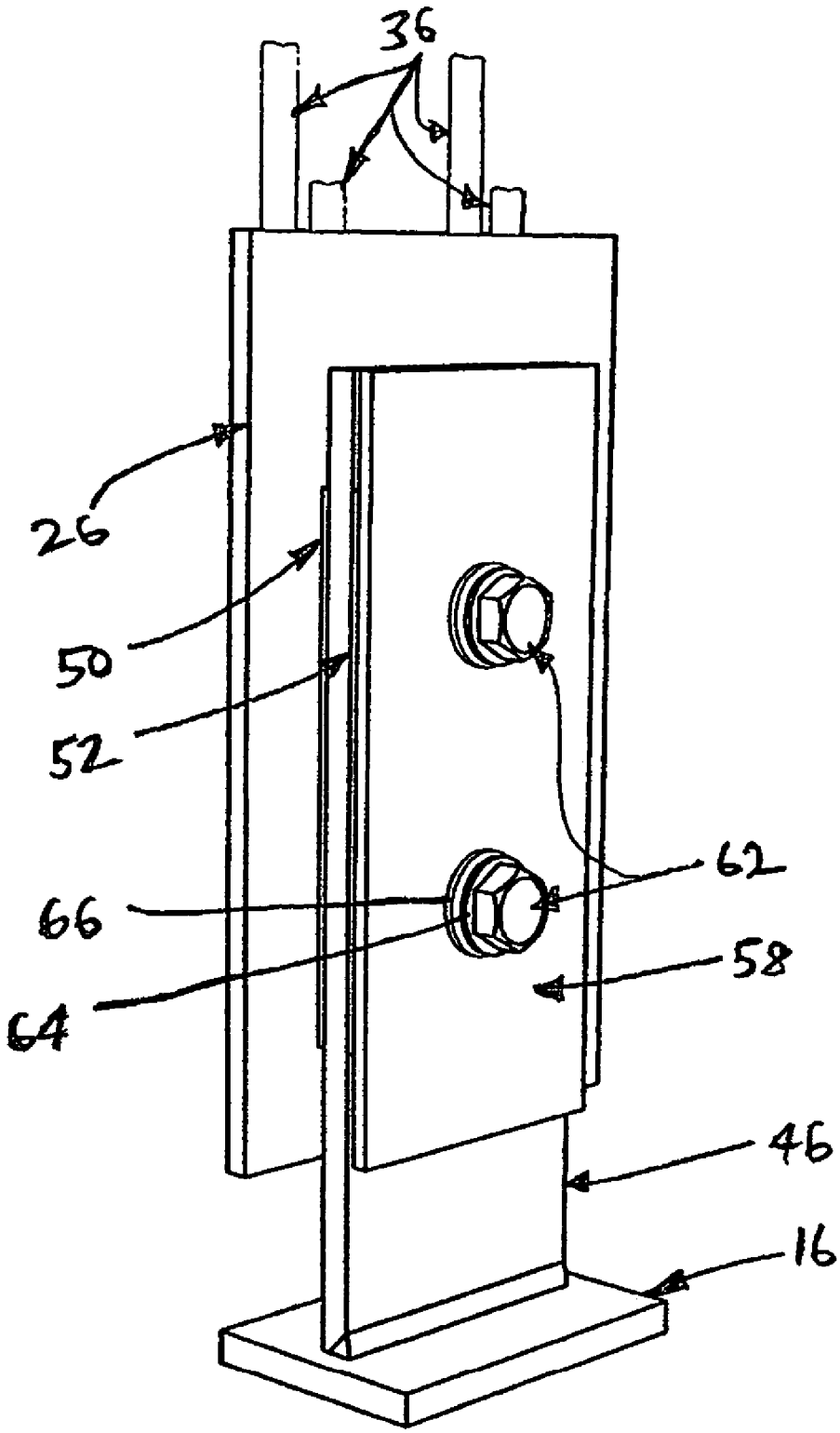
FIG. 3 is a detailed pictorial view of the base connection of FIG. 1.
Figure 8:
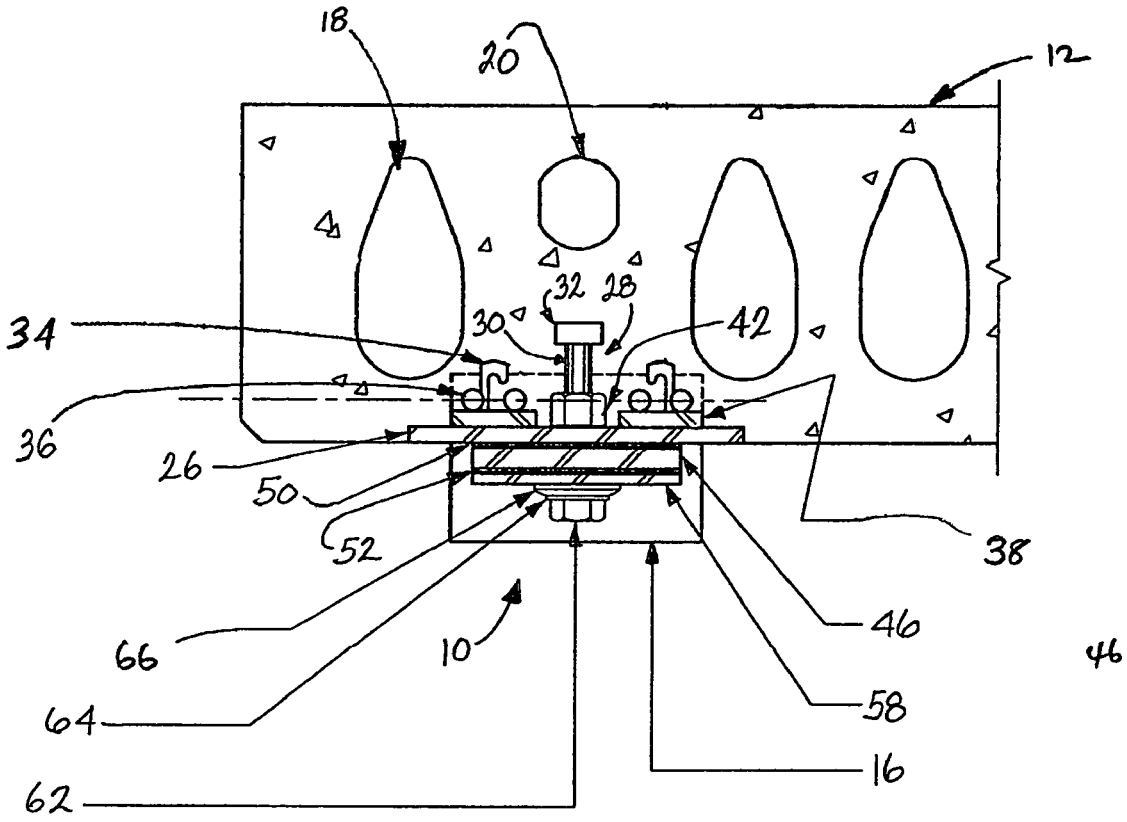
FIG. 8 is a cross-section view of the base connection along line 8-8 in FIG. 4.

Referring now to FIGS. 2 and 8, wall panel 12 is preferably in the form of a precast wall panel that is shipped to a construction site, or pre-cast on site, and installed on foundation 14 using base connection 10 (See FIG. 8). Wall panel 12 is of the type that is commercially available from an entity such as The Spancrete Group, Inc. of Waukesha, Wis. Typically, wall panel 12 includes vertically extending cores 18 that are laterally spaced throughout its width. Referring specifically to FIG. 8, in the area of each base connection 10, wall panel 12 is provided with a reduced core 20 to provide sufficient material for securing the base connection 10. As shown in FIG. 2, wall panel 12 also includes reduced cores 22 in the areas of roof insert connections 24 (FIG. 1), which are not within the scope of the present invention.

Figure 5:
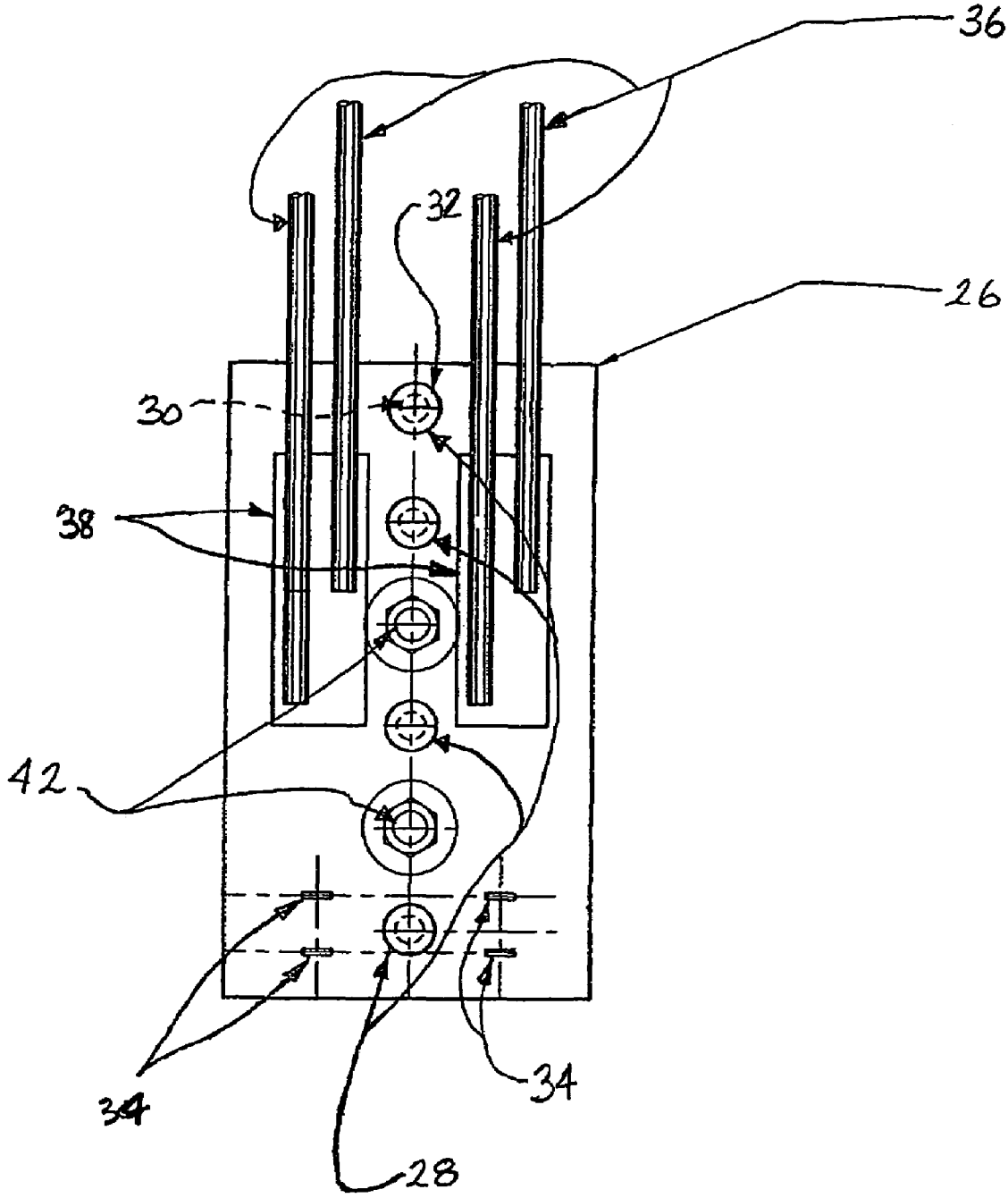
FIG. 5 is a detailed rear elevation view of the base connection FIG. 1.

As shown in FIGS. 7 and 8, base connection 10 includes a wall plate 26 that is embedded within the material of concrete wall panel 12 toward its lower end. Wall plate 26 is embedded in wall panel 12 at the time of production of wall panel 12. Referring now to FIGS. 5 and 7-8, the wall plate 26 is anchored within wall panel 12 using a series of horizontally aligned studs 28, each of which includes a shank 30 that is secured to the inside surface of wall plate 26, such as by welding. Each stud 28 also includes a head 32 that is spaced inwardly from the inner surface of wall plate 26.

Still referring to FIGS. 5 and 7-8, a series of laterally spaced rectangular studs 34 are also secured to the inside surface of wall plate 26 toward its lower end, such as by welding. Rectangular-shaped studs 34 are located on either side of the lowermost studs 28. The rectangular-shaped studs 34 function to rigidly anchor the lower end of wall plate 26 within wall panel 12.

Figure 4:
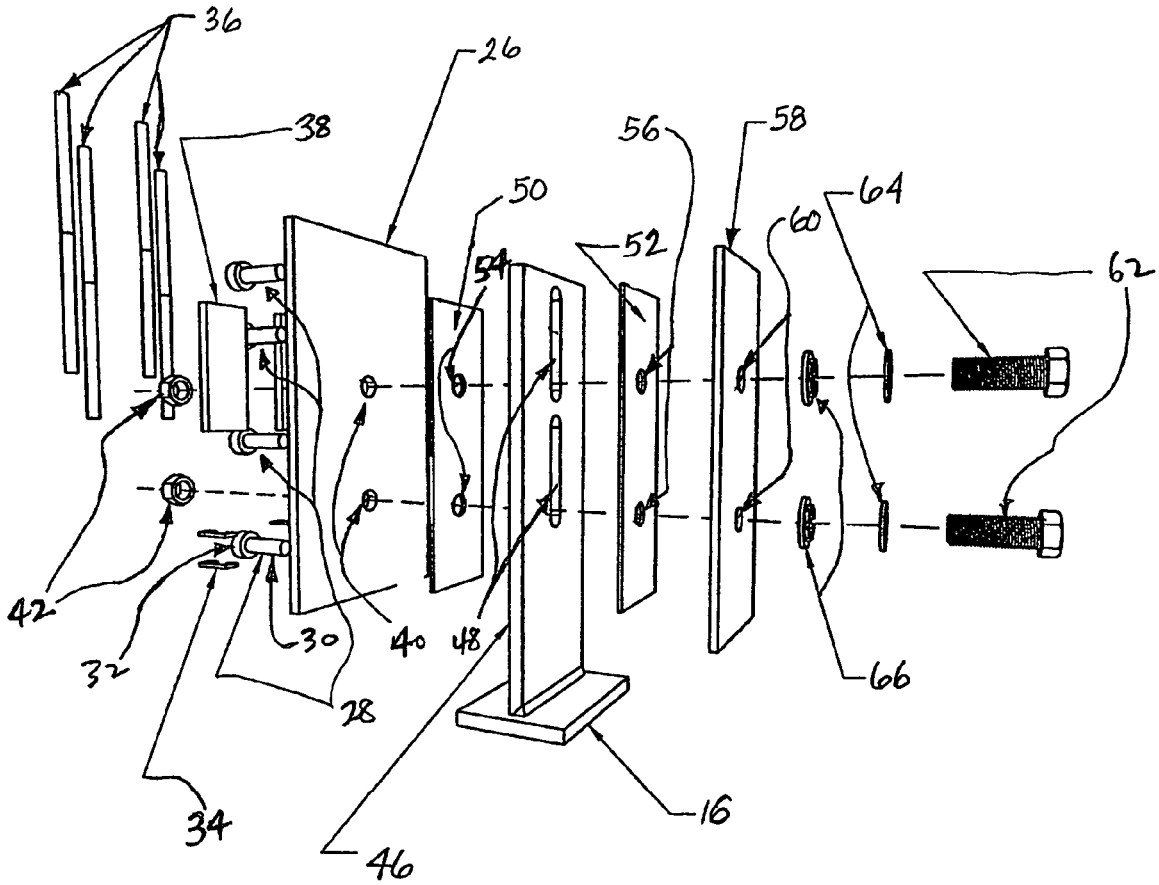
FIG. 4 is a detailed exploded pictorial view of the base connection of FIG. 1.

Referring now to FIGS. 4-5 and 7-8, wall plate 26 is further anchored within wall panel 12 via a series of reinforcing bars 36. The lower ends of reinforcing bars 36 are interconnected with an upper area of wall plate 26 via spacer plates 38. In the illustrated construction, spacer plates 38 are welded to the inner surface of wall plate 26, and the lower ends of reinforcing bars 36 in turn are welded to the inner surfaces of spacer plates 38. Reinforcing bars 36 extend upwardly above the upper end of wall plate 26. Each reinforcing bar 36 extends approximately 4 to 5 feet above the upper end of wall plate 26 into the material of wall panel 12. Referring specifically to FIG. 7, each reinforcing bars 36 is spaced from the inner surface of wall panel 12 by the thickness of wall plate 26 combined with the thickness of spacer plate 38, which in the illustrated embodiment is about ¾". Of course, it should be understood that the thickness of the spacer plate 38 can vary. As shown in FIGS. 4-5 and 7, the illustrated rectangular studs 34 are generally located below the reinforcement bars 36. Referring specifically to FIG. 4, wall plate 26 further includes a pair of openings 40. A threaded receiver or nut 42 is secured to the inside surface of wall plate 26, such as by welding, and the threaded passage of each nut 42 is in alignment with one of openings 40.

All of the above-described components are preferably embedded within concrete wall panel 12 during production of wall panel 12. Yet, the one or more the above-described components may be attached after production of the wall panel 12.

Still referring to FIGS. 4 and 7-8, the foundation plate 16 is installed in the foundation 14 by embedding the foundation plate 16 within the foundation 14 in a manner as is known. The foundation plate 16 is located to at least partially extend underneath the wall panel 12. A foundation connection or mounting plate 46 is secured in generally perpendicular alignment relative to the foundation plate 16 so as to extend upwardly therefrom. In the illustrated embodiment, mounting plate 46 extends generally vertically, and defines a lower end that is secured to foundation plate 16 by welding. It is understood, however, that mounting plate 46 may be secured to foundation plate 16 in any other satisfactory manner (e.g., welding) that provides rigid interconnection between mounting plate 46 and foundation plate 16. Mounting plate 46 provides a means by which the embedded components of wall panel 12, as discussed above, are utilized so as to secure the lower end of wall panel 12 to foundation 14.

Referring specifically to FIG. 4, mounting plate 46 includes a pair of vertically extending, vertically aligned slots 48. Slip plates 50 and 52 are located one on either side of mounting plate 46. An inner slip plate 50 located between mounting plate 46 and wall plate 26, and an outer slip plate 52 located on the opposite side of mounting plate 46. Inner slip plate 50 includes a pair of vertically aligned openings 54, and outer slip plate 52 includes a pair of vertically aligned openings 56. Slip plate openings 54 and 56 are in alignment with wall plate openings 40, and are positioned so as to be in alignment with the lower ends of mounting plate slots 48.

As illustrated in FIGS. 3-4 and 7-8, a cover plate 58 is located outwardly of outer slip plate 52, such that outer slip plate 52 is located between the inner surface of cover plate 58 and the outer surface of mounting plate 46. With this construction, inner slip plate 50 is sandwiched between mounting plate 46 and wall plate 26, and outer slip plate 52 is sandwiched between mounting plate 46 and cover plate 58. Referring specifically to FIG. 4, the cover plate 58 includes a pair of vertically aligned openings 60, which are in alignment with the slip plate openings 54, 56 and the wall plate openings 40.

Figure 6:
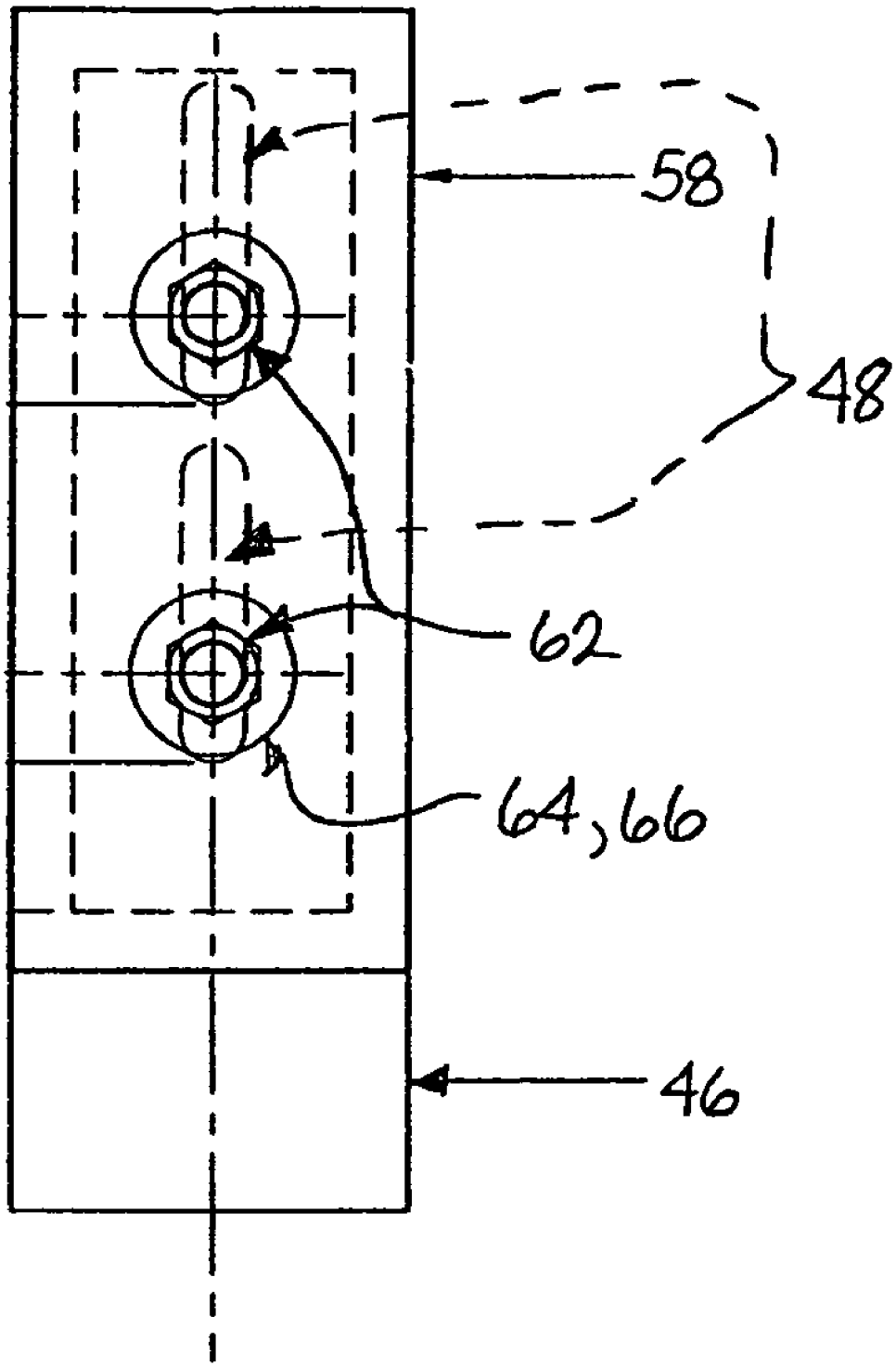
FIG. 6 is a detailed front elevation view of the base connection of FIG. 1.

Referring specifically now to FIG. 4, base connection 10 further includes a pair of bolts 62, which function as a means for securing mounting plate 46, cover plate 58 and slip plates 50, 52 to wall plate 26. Each bolt 62 includes a threaded shank that is adapted to extend through one of cover plate openings 60, one of slip plate openings 54, 56, one of elongated slots 48 and one of wall plate openings 40 into engagement with the threads of one of embedded nuts 42. As shown in FIGS. 4 and 6, the head of each bolt 62 bears against a washer 64, and a Belleville-type spring washer 66 is located between each washer 64 and the outer surface of cover plate 58. The Belleville-type spring washer 66 is generally conical shaped and configured to deflect when under a predetermined compression force. With the spring washer 66 sandwiched between cover plate 58 and the head of bolt 62, this construction provides resiliency in the engagement of the shank of bolt 62 with embedded nut 42.

After base connection 10 is assembled as shown and described above, the lower end of wall panel 12 is located slightly above the upper surface of foundation 14. As shown in FIG. 7, the space between the lower end of wall panel 12 and foundation 14 is filled with a grout 68, in a manner as is known.

As noted previously, base connection 10 is adapted for use in buildings that are required to withstand seismic loading conditions. Slots 48 in mounting plate 46 accommodate vertical displacements between wall panel 12 and foundation 14, and spring washers 66 accommodate lateral displacement between wall panel 12 and foundation 14. In addition, the cantilevered construction of mounting plate 46 relative to foundation 14 provides additional flexibility in the connection of wall panel 12 to foundation 14.

Testing of base connection 10 has been conducted in order to determine the ability of base connection 10 to provide ductile characteristics that are required in order to connect wall panel 12 to foundation 14 while controlling the peak force transferred into the wall 12 concrete from a seismic event. In testing, connection 10 exhibited a large amount of energy absorption. Visual examination of the base connection 10 during testing revealed that, as the joint is pulled open, slip is first evident between the wall plate 26 and the mounting plate 46. During this initial slip, the wall plate 26 did not move relative to the mounting plate 46. Subsequently, as the tensile displacement grew, the cover plate 58 began to move with the wall plate 26, and to slip relative to mounting plate 46. Thus, slip first occurred between wall plate 26 and mounting plate 46, where nearly all of the shear force was initially being transferred by friction. The bolts 62 transfer little shear until slip is initiated and the bolt 62 deforms. As further deformation was applied, the shear transferred by the bolts 62 was sufficient to overcome friction on the interface between mounting plate 46 and cover plate 58, so that cover plate 58 began to slip. Base connection 10 thus exhibited elastic capacity, in that an initial tension tie capacity is available before slip is initiated. Connection 10 also exhibited sufficient peak capacity to transfer peak shear forces through connection 10, and little deterioration in elastic resistance capacity upon repeated cycling. Connection 10 also performs as a friction damping system, which dissipates energy through multiple cycles of displacement at varying levels.

Figure 9:
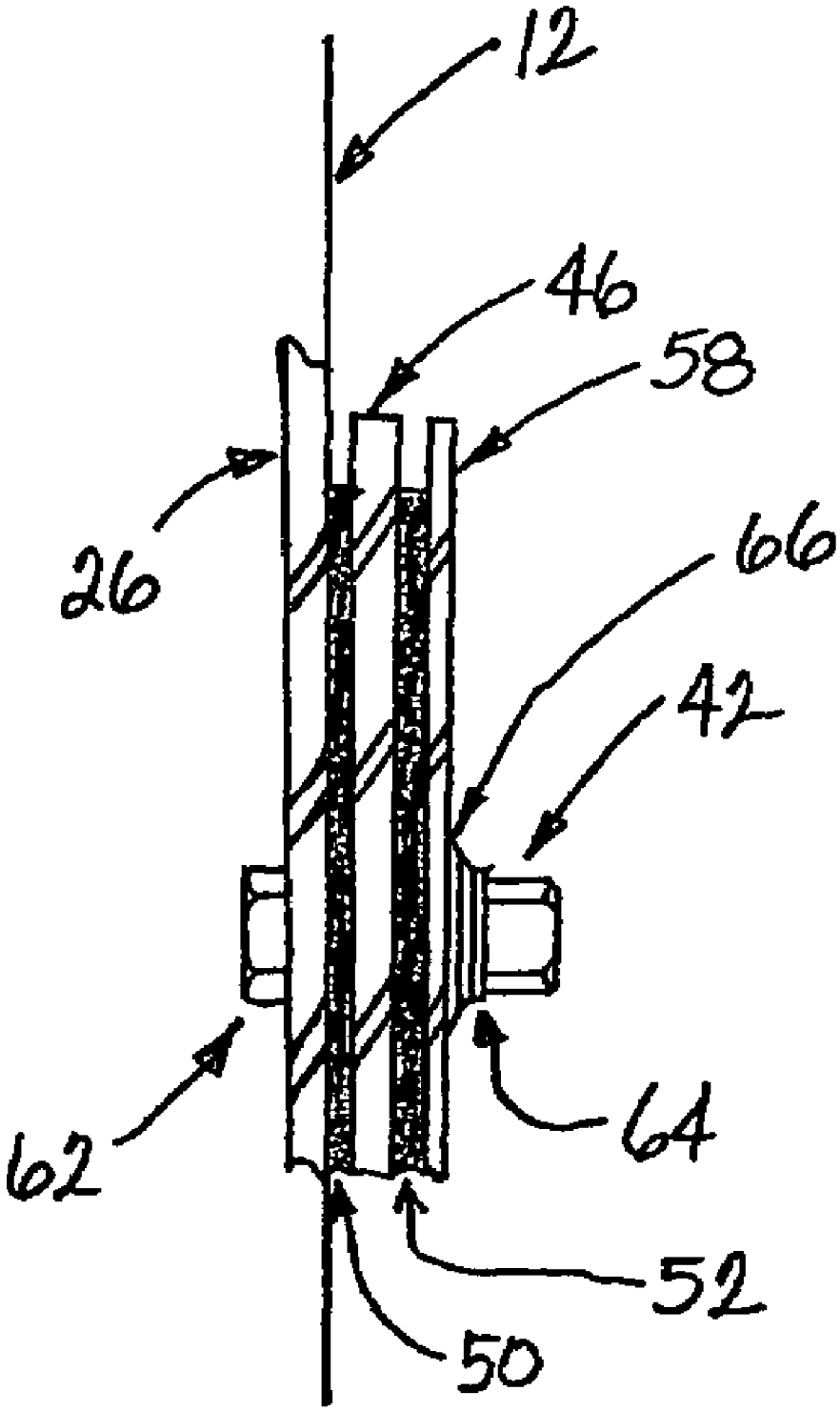
FIG. 9 is a cross-section of another embodiment of the base connection in accordance with the present invention.

While base connection 10 has been shown and described with respect to a specific embodiment, it is contemplated that various alternatives and modifications are also within the scope of the present invention. For example, and without limitation, the specific means by which wall plate 26 is anchored within concrete wall panel 12 may vary from that shown and described. In addition, while nuts 42 are illustrated as being embedded within the material of concrete wall panel 12, it is also contemplated that the positions of bolts 62 and nuts 42 may be reversed, in that bolts 62 may be embedded within wall panel 12 and configured so that the shank of each bolt 62 extends outwardly from an embedded wall plate, as illustrated in FIG. 9. In a configuration such as this, the nuts 42 bear against spring washers 66. In addition, while connection 10 is shown as having a pair of connectors that extend through aligned openings and slots in the various plates, it is also understood that any number of connectors may be employed. In addition, the slots 48 in mounting plate 46, which are illustrated as being vertically elongated and aligned, may be positioned in a different relationship, either in or out of alignment with each other. Further, base connection 10 may be used to secure a wall panel to any underlying structure to which a mounting plate such as 46 may be secured, and is not limited to connection to foundation 14 via an embedded foundation plate 16 as described. In addition, it is also contemplated that base connection 10 may be used to secure a cast-in-place wall to a foundation 14, where the components 26, 28, 34, 36 and 42 embedded in wall panel 12 are embedded within the concrete material of the wall 12 at the time the wall 12 is cast in place on an underlying support structure 14.

While the invention has been shown and described with respect to particular embodiments, it is understood that alternatives and modifications are possible and are contemplated as being within the scope of the present invention.

The above discussion, examples, and embodiments illustrate our current understanding of the invention. However, since many variations of the invention can be made without departing from the spirit and scope of the invention, the invention resides wholly in the claims hereafter appended.

We claim:

1. A base connection for supporting a concrete wall panel on an underlying support structure, comprising:

a generally vertical mounting plate secured to and extending upwardly from the support structure, wherein the mounting plate includes one or more generally vertically-elongated slots;

a wall plate embedded within the concrete wall panel toward a lower end defined by the concrete wall panel;

a pair of slip plates, wherein the slip plates are located one on either side of the mounting plate, and wherein an inner one of the slip plates is located between the mounting plate and the wall plate;

a cover plate located outwardly of the mounting plate, wherein an outer one of the slip plates is located between the cover plate and the mounting plate;

one or more threaded connectors extending between and interconnecting the cover plate and the embedded wall plate, wherein each threaded connector extends through openings in the slip plates and through one of the generally vertically elongated slots in the mounting plate; and a spring washer interposed between the cover plate and an outer end defined by each threaded connector.

2. The base connection of claim 1, wherein the vertically elongated slots are generally vertically aligned with each other, and wherein the one or more threaded connectors comprise a pair of connectors, each of which extends through one of the vertically elongated slots.

3. The base connection of claim 1, wherein the wall plate includes one or more openings and one or more threaded receivers in alignment with each of the openings through the slip plates, and wherein each threaded connector includes a head and a threaded shank, and wherein each spring washer is located between the cover plate and the head of one of threaded connectors, and wherein the threaded shank of each threaded connector is engaged with one of the threaded receivers.

4. The base connection of claim 1, further comprising:

a foundation plate attached at a lower edge of the mounting plate, the foundation plate aligned generally perpendicular to the mounting plate and embedded in the support structure.

5. The base connection of claim 4, wherein the foundation plate extends underneath the wall panel.

6. The base connection of claim 1, further comprising:

a spacer plate attached at an inner surface of the wall plate facing the concrete wall panel.

7. The base connection of claim 1, further comprising:

at least one vertically aligned reinforcing bar embedded in the concrete wall panel, wherein each reinforcement bar is attached to the wall plate via the spacer plate, the at least one reinforcement bar extending above an upper end of the wall plate.

8. The base connection of claim 1, wherein each of the slip plates is comprised of brass.

9. The base connection of claim 1, further comprising:

at least one rectangular-shaped stud embedded to anchor the wall plate to the concrete wall panel.

10. The base connection of claim 1, further comprising at least one headed stud located at an inner face of the wall plate facing the concrete panel wall, wherein the at least one headed stud includes a shank having a free end attached at the wall plate.

* * * * *